US009890611B2

(12) United States Patent
Lee et al.

(10) Patent No.: US 9,890,611 B2
(45) Date of Patent: Feb. 13, 2018

(54) ELECTROMECHANICAL DEVICE FOR ENGAGING SHIFTABLE KEYS OF DOWNHOLE TOOL

(71) Applicant: HALLIBURTON ENERGY SERVICES, INC., Houston, TX (US)

(72) Inventors: Shao Hwa Lee, Singapore (SG); Mark S. Holly, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 112 days.

(21) Appl. No.: 15/028,880

(22) PCT Filed: Jun. 22, 2015

(86) PCT No.: PCT/US2015/036975
§ 371 (c)(1),
(2) Date: Apr. 12, 2016

(87) PCT Pub. No.: WO2016/209204
PCT Pub. Date: Dec. 29, 2016

(65) Prior Publication Data
US 2017/0167227 A1 Jun. 15, 2017

(51) Int. Cl.
*E21B 34/14* (2006.01)
*E21B 28/00* (2006.01)

(52) U.S. Cl.
CPC ..... *E21B 34/14* (2013.01); *E21B 28/00* (2013.01)

(58) Field of Classification Search
CPC ..... E21B 23/00; E21B 23/04; E21B 34/14
See application file for complete search history.

(56) References Cited

U.S. PATENT DOCUMENTS 5,145,228 A 9/1992 Boyle
6,152,219 A 11/2000 Vick, Jr. et al.
6,260,616 B1 7/2001 Carmody et al.
(Continued)

FOREIGN PATENT DOCUMENTS

WO 2010084353 A2 7/2010
WO 14140609 A2 9/2014
WO 2015065335 A1 5/2015

OTHER PUBLICATIONS

Schlumberger: ReSOLVE Selective Universal Shifting Tool (UST); Aug. 2012; http://www.slb.com/services/well_intervention/wireline_cased_hole_intervention/resolve_wireline_intervention_tools/resolve_universal_shifting_tool.aspx.
(Continued)

*Primary Examiner* — David J Bagnell
*Assistant Examiner* — Nikhil Menon
(74) *Attorney, Agent, or Firm* — Polsinelli PC

(57) ABSTRACT

A well intervention tool for shifting a door structure within a well casing. The well intervention tool has independently shiftable keys which releasably engage with portions of the door structure. When the keys are engaged with the door structure, the well intervention tool can be used to move the door structure uphole and downhole. The well intervention tool can include a vibration motor to cause the keys to vibrate in order to displace debris within the door structure. The well intervention tool can include a rotational motor to cause the keys to rotate in order to displace debris within the door structure. The keys can have teeth which are shaped and spaced to shift debris while minimizing damage to the well casing.

20 Claims, 11 Drawing Sheets

(56) References Cited

U.S. PATENT DOCUMENTS

| | | | | |
|---|---|---|---|---|
| 6,474,349 | B1 | 11/2002 | Laker | |
| 6,612,547 | B2 | 9/2003 | Carmody et al. | |
| 7,051,810 | B2 | 5/2006 | Clemens et al. | |
| 8,056,622 | B2 | 11/2011 | Lynde | |
| 8,210,251 | B2 | 7/2012 | Lynde et al. | |
| 8,371,389 | B2 | 2/2013 | Hofman et al. | |
| 8,490,702 | B2 | 7/2013 | Stromquist et al. | |
| 8,794,337 | B2 | 8/2014 | Thomas et al. | |
| 8,973,662 | B2 | 3/2015 | Xu et al. | |
| 2011/0186303 | A1* | 8/2011 | Scott | E21B 34/066 166/373 |
| 2011/0253376 | A1 | 10/2011 | Krpec | |
| 2012/0085548 | A1 | 4/2012 | Fleckenstein et al. | |
| 2013/0319658 | A1 | 12/2013 | Huh et al. | |
| 2013/0333895 | A1 | 12/2013 | Le Briere et al. | |
| 2014/0060803 | A1* | 3/2014 | Gano | E21B 23/01 166/66.5 |
| 2014/0076584 | A1 | 3/2014 | Vick | |
| 2015/0152714 | A1* | 6/2015 | Andersen | E21B 33/124 166/373 |
| 2016/0123112 | A1* | 5/2016 | Purkis | E21B 34/08 166/320 |
| 2017/0107792 | A1* | 4/2017 | Lee | E21B 34/14 |

OTHER PUBLICATIONS

International Search Report and Written Opinion dated Mar. 21, 2016 in International Application No. PCT/US2015/036975.

* cited by examiner

ELECTROMECHANICAL DEVICE FOR ENGAGING SHIFTABLE KEYS OF DOWNHOLE TOOL

CROSS-REFERENCE TO RELATED APPLICATIONS

This application is a national stage entry of PCT/US2015/036975 filed Jun. 22, 2015, said application is expressly incorporated herein in its entirety.

FIELD

The present disclosure relates generally to well bore completion operations. In particular, the subject matter herein generally relates to aperture control devices within a well bore.

BACKGROUND

During various phases of oil and gas operations it becomes necessary to control fluid communication between the inside of a well casing and the exterior of the well casing. A well casing and/or well liner will generally have one or more access points or holes positioned along its side. A movable door apparatus will have one or more complimentary openings. When an opening or "door" of such a movable door apparatus is moved into alignment with an access point of the well casing, inflow of materials, such as hydrocarbons exterior to the casing, into the interior or inside of the well casing is enabled. By moving the slidable doors out of alignment with openings in the well casing, inflow of materials is controlled. A shifting device, such as a well intervention tool, located within the well casing and acting under a force imposed by a tractor or under the force of an actuator, is used to shift the position of the slidable doors. The shifting device comprises shifter keys which are configured to engage the profile of the slidable doors. The keys may be independently movable. Once the profile of the slidable door is successfully engaged, the door can be moved uphole or downhole, as needed.

BRIEF DESCRIPTION OF THE DRAWINGS

Implementations of the present technology will now be described, by way of example only, with reference to the attached figures, wherein.

DETAILED DESCRIPTION

Figure 1:
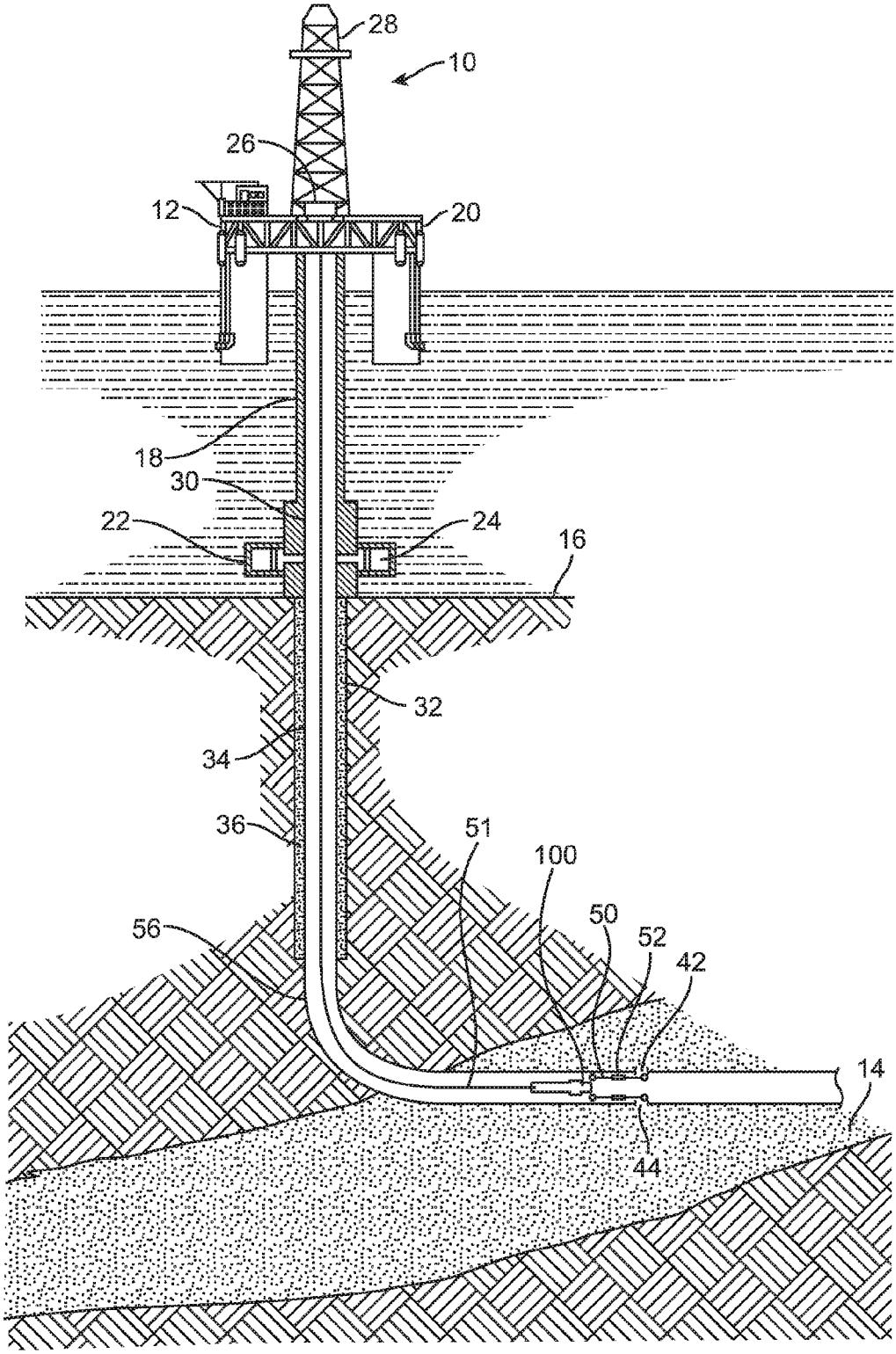
FIG. 1 is a schematic diagram of an embodiment of a wellbore operating environment in which a downhole tool, such as a well intervention tool as described herein, may be deployed.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side or bottom of the page is downhole compared to the left-hand side, further the top of the page is toward the surface, and the lower side of the page is downhole.

Several definitions that apply throughout this disclosure will now be presented. The term "coupled" is defined as connected, whether directly or indirectly through intervening components, and is not necessarily limited to physical connections. The term "outside" refers to a region that is beyond the outermost confines of a physical object. The terms "comprising," "including" and "having" are used interchangeably in this disclosure. The terms "comprising," "including" and "having" mean to include, but not necessarily be limited to the things so described.

Disclosed herein is a well intervention tool which can be used to move or shift a slidable door apparatus within a casing interior to a well bore. The well intervention tool can have a longitudinal body, appropriately sized and configured to be moved along a length of the interior of the casing. The longitudinal body can have an inner cavity which houses various components such as those described herein. The longitudinal body can have one or more apertures or gaps running along its length. The aperture can be a slot sized to receive a key assembly which can be used to releasably couple the well intervention tool with a portion of the slidable door apparatus. The door apparatus can include one or more gaps or apertures, which when substantially aligned with a corresponding gap or aperture in a well casing, enable materials such as hydrocarbons to enter the well intervention tool from outside the casing for extraction. When the door apparatus is shifted out of alignment with such apertures, the flow of materials into the casing can be controlled or prevented, or both.

The well intervention tool as disclosed herein can help remove or prevent the collection of debris in the area of the door apparatus. Debris can interfere with coupling the keys to the door structure, either by preventing the well intervention tool from locating the door structure, or by preventing a good fit, or both. Various solutions to this problem involving the key assembly are disclosed herein.

The well intervention tool can also include a rotation assembly which is at least partially housed within the inner cavity. The rotation assembly can be actuated to cause the longitudinal body as well as the key assembly to rotate. Rotating the key assembly, and hence the key portion, can better seat the key portion within a receiving area of the slidable door apparatus because the rotation action thereof can have the effect of removing, shifting, or compensating for debris between the key portion and a key-receiving area of the slidable door apparatus within the casing. Thus engagement and interaction between the key assembly and the slidable door apparatus are encouraged.

The well intervention tool can also include a vibration assembly which is at least partially housed within the inner cavity. The vibration assembly can be actuated to cause the vibration assembly to vibrate the key portion. Vibrating the key assembly, and hence the key portion, can better seat the key portion within a receiving area of the slidable door apparatus because the vibrating action thereof can have the effect of removing, shifting, or compensating for debris between the key portion and a key-receiving area of the slidable door apparatus within the casing. Thus engagement and interaction between the key assembly and the slidable door apparatus are enhanced.

The keys of the well intervention tool can include various teeth or patterns which can improve displacement of the debris, thus improving engagement between the keys and the door structure.

FIG. 1 illustrates a schematic view of an embodiment of a wellbore operating environment in which a downhole tool, such as a packer, may be deployed. As depicted, an offshore oil or gas well 10 may include a semi-submersible platform 12 centered over a submerged oil and gas formation 14 located below the sea floor 16. A subsea conduit 18 extends from the deck 20 of the platform 12 to a wellhead installation 22, including blowout preventers 24. The platform 12 has a hoisting apparatus 26 and a derrick 28 for raising and lowering pipe strings, such as substantially tubular, longitudinally extending inner work string 30. The wellbore 32 extends through the various earth strata including formation 14. An upper casing 34 is cemented within a vertical section of wellbore 32 by cement 36. A liner 56 is secured to the lower end of the upper casing 34 by any means known in the art, such as expandable liner hangers, and the like. The liner 56 can be a casing, tubing or other tubular conveyance for fluids such as hydrocarbon or other fluidic materials. A further outer casing (not shown) may additionally be provided between the liner 56 and walls of the wellbore 32 and which may or may not be cemented.

The liner 56 may include one or more gaps or apertures 42, 44 through which materials such as hydrocarbons from within the formation 14 may pass into the liner 56 for extraction. FIG. 1 also depicts a well intervention tool 100 which can be used to move a slidable door apparatus 50 with the liner 56 to control the inflow of the materials to be collected by the well 10.

Although FIG. 1 depicts a horizontal well, it should be understood by one skilled in the art that the present disclosure describing a well intervention tool can also be well-suited for use in vertical wells, slanted wells, multilateral wells, and the like. Also, although FIG. 1 depicts an offshore operation, it should be understood by one skilled in the art that the present disclosure is equally well-suited for use in onshore operations.

Figure 2:
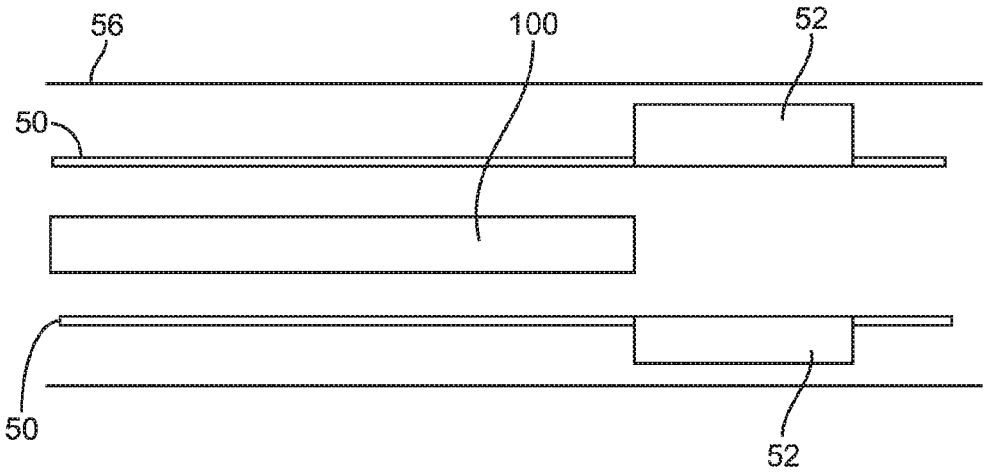
FIG. 2 illustrates an example embodiment of a well intervention tool as described herein.

FIG. 2 illustrates an example embodiment of the well intervention tool 100 described herein. During a search mode, the well intervention tool 100 will move uphole and downhole within the well casing or liner 56, driven by a tractor or under gravity. The well intervention tool 100 can be provided via a conveyance 51 which can include wireline, slickline, e-line, tubing, coiled tubing or other conveyance or tubular conveyance. The tool 100 has one or more shifter keys (see FIG. 3) which search for a slidable door structure 50 when in search mode. The door structure 50 contains at least one opening 52 which, when aligned with an opening 42 in the liner, will allow materials to enter the casing. The keys are shaped and configured such that they will engage the structure 50 once the sliding door profile is found. Once engaged by the keys, the door structure 50 can be shifted uphole or down hole. As discussed above, in horizontal completions the sliding door structure 50 can have debris inside it which can interfere or prevent a successful engagement by the keys. Vibrating the shifting keys, enables the shifting keys to be pushed into a greater depth with respect to an engagement region of the door structure 50, thus increasing the likelihood of engagement, and hence the success of a shifting job. As discussed herein, the functionality of the shifting tool 100 can be enhanced when the shifting keys have a toothed profile because a toothed profile can be used to displace debris, allowing for deeper penetration by the keys.

Figure 3:
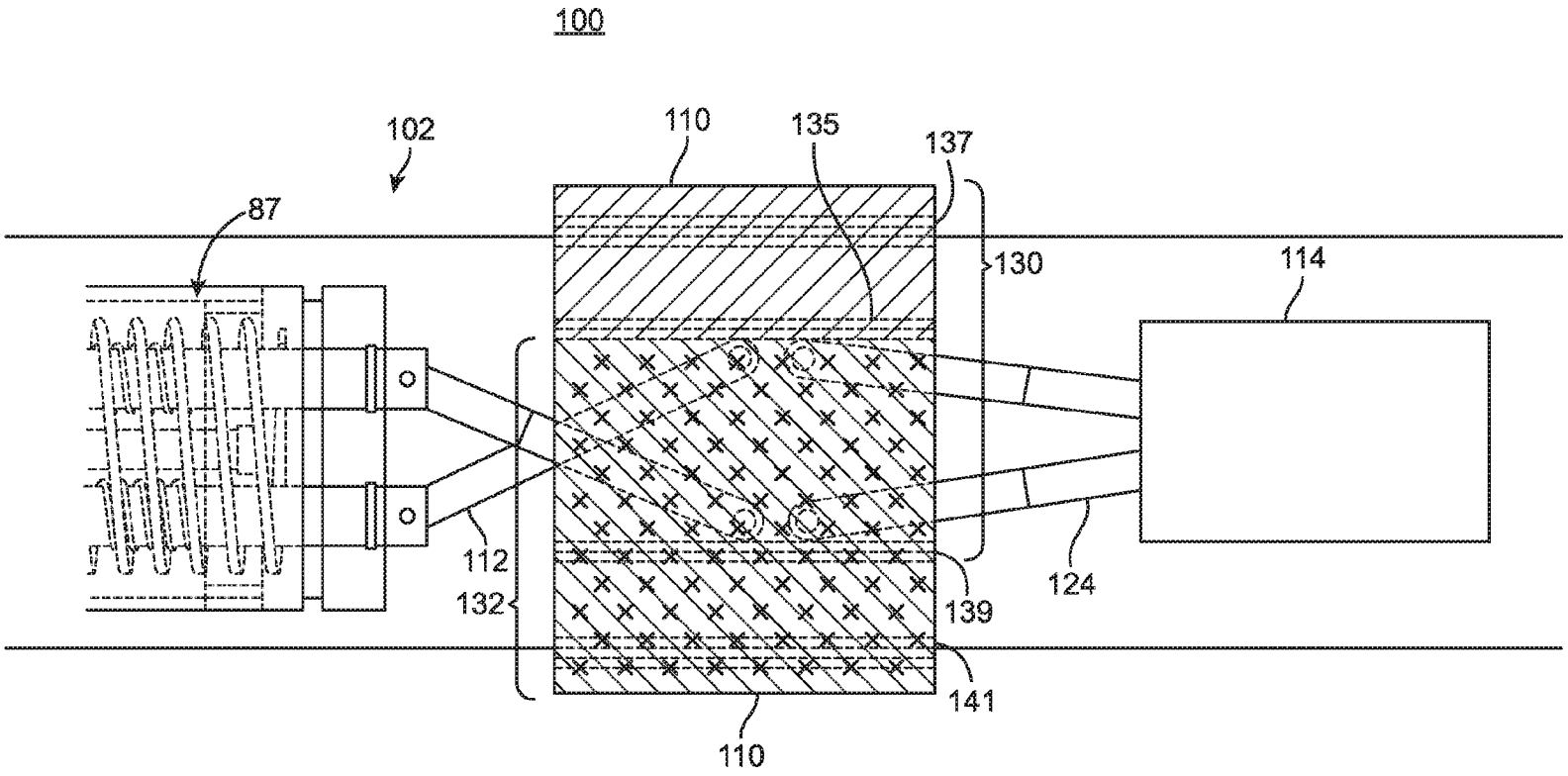
FIG. 3 illustrates a side view of a well intervention tool as described herein.

FIG. 3 illustrates a side view of a well intervention tool 100. As shown, the well intervention tool has a longitudinal body 102 which houses keys 110. The keys 110 are urged outward, away from the interior of the longitudinal body 102, by translating actuators 112, which in this example are rods connected to a driving mechanism 87, which can be a linear drive motor or any suitable driving mechanism known in the art. The keys can be connected to translatable sleeves 130, 132. The translatable sleeves 130, 132 can be partially nested, one within the other. The translating actuators 112 are connected to an underside 135, 139 of the keys 110. The keys 110 are urged by the translating mechanisms 112 from a first position 137, 141 in which they are substantially in alignment with longitudinal body 102 to an extended position away from the longitudinal body 102 as shown, when they are engaged with a slidable door structure. The keys 110 can also be connected by actuators 124 to a rotation device 114 or a vibration device 214. In the case of a rotation device 114, rotary motion is used to rotate the shifting keys 110 to a position to avoid the debris at the bottom of the casing/sleeve. This can be accomplished once the tool 100 has engaged into the sliding door or after some failed trials to engage the door. As discussed herein, the keys 110 will engage with a slidable door structure once the sliding door profile is found. If the search fails, the keys 110, 219 can be rotated by a preset angle, (for example, twenty degrees) and the tool movement can be repeated to search again. Searching and change of rotation can be done multiple times until the correct angle of rotation is found to engage the sliding door structure properly. In the case of a vibration device, a mechanical vibration can be introduced by a motor with an off-balanced wheel attached to a shaft. Once the keys 110 are in position the motor is actuated and a pulse is transmitted thru the linkages 124 into the keys 110. The motor can be hydraulic or electromechanical in nature. The vibration can be introduced in a radial pattern or a linear depending on the application and position of the motor and unbalanced load.

Figure 4:
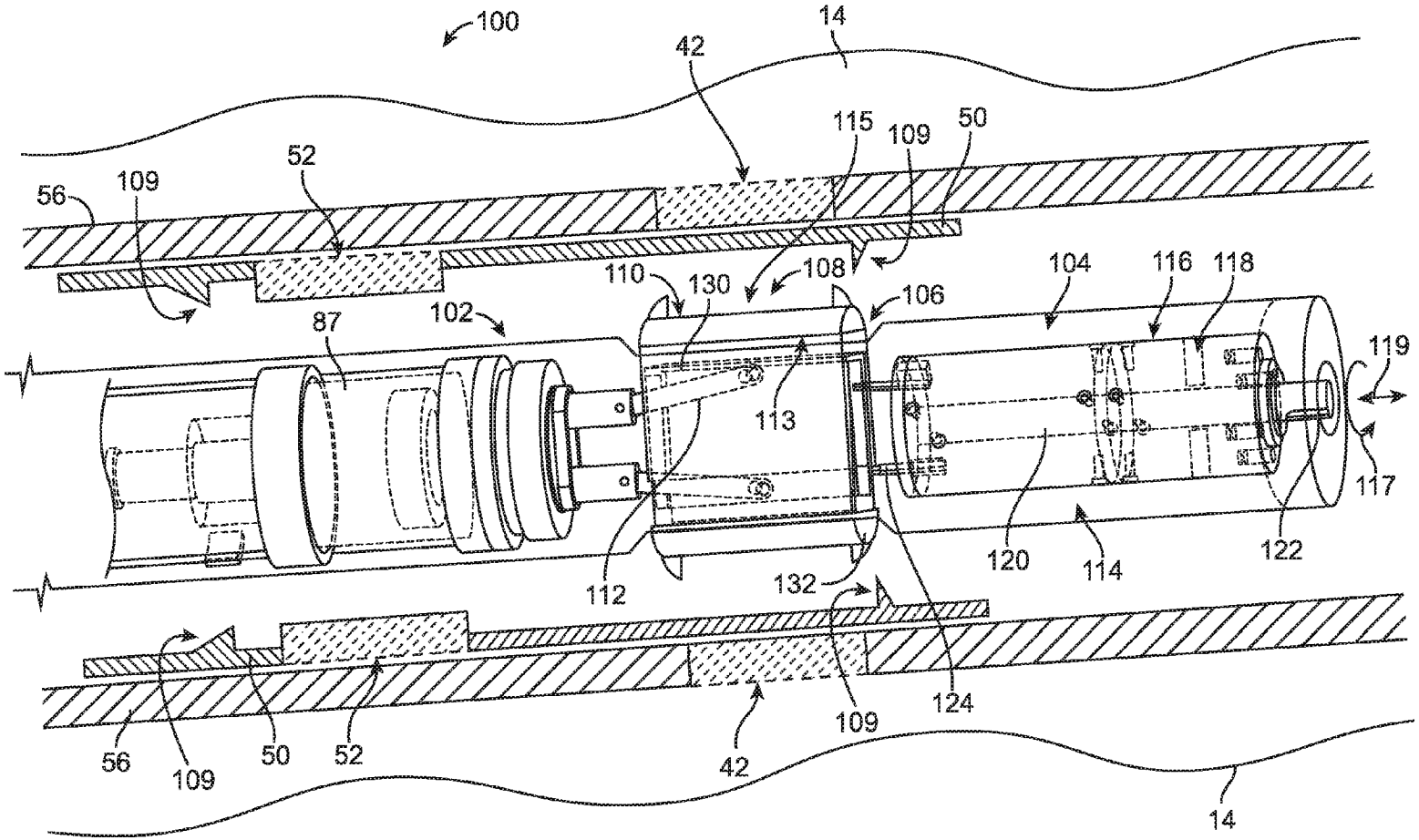
FIG. 4 illustrates an example of a well intervention tool having rotational functionality.

FIG. 4 illustrates an example of a well intervention tool 100 having rotational functionality. The tool 100 has a longitudinal body 102 housing various components within an inner cavity 104. The components include translatable keys 110 which are urged outwardly from within the longitudinal body 102, through apertures 106 in the longitudinal body 102 by translating actuators 112 connected to an actuation mechanism 87, such as a motor or engine or any suitable device known in the art. The actuation mechanism 87 pushes the actuators 112, in this case pushrods, which in turn push the keys 110 away from the longitudinal body 102 in order to cause the keys 110 to engage with engagement portions 109 of a slidable door structure 50. The pushrods 112 can be pivotably connected to the actuation mechanism 87 and the keys 110, or pivotably connected to sleeves 130, 132 which are connected to the keys 110. The slidable door structure 50 has an aperture or door 52 which when moved into alignment with an aperture 42 in the well casing 56 allows materials such as hydrocarbons to enter the casing 56 from within a formation 14. The components also include a rotation assembly 114 which can be used to rotate the longitudinal body 102 and the keys 110 in order to improve the seating of the keys 110 to the door structure 50. As indicated, rotating the keys 110 can dislodge debris from within the door structure 50, leading to a better fit and thus improved shifting of the door structure 50 within the casing 56. As illustrated, the rotation assembly can include a casing 116 containing an actuable motor 118 such as a linear drive motor. The motor 118 can rotate 117 the casing 116 (and hence the keys 110) about an axis 119 of a rod 120 connected to an interior portion 122 of the casing 116. The rotation assembly 114 can be coupled to rotation actuators 124, which are rods in this example. The actuators 124 can be coupled to an inner side of a key 110 or to a sleeve 130, 132 connected to a key 110. Thus, by rotating the casing 116 about the rod 120, the longitudinal body 102 and the key assembly 108 are also rotated within the casing 56. As discussed, rotating the keys 110 can enable the outer portion 115 of the keys 110 to remove debris from the door structure 50, thus leading to improved shifting of the door structure. The actuable motor 118 can be a stepper motor with a linear drive or a brushless DC motor or other suitable motor or device known in the art.

Figure 5:
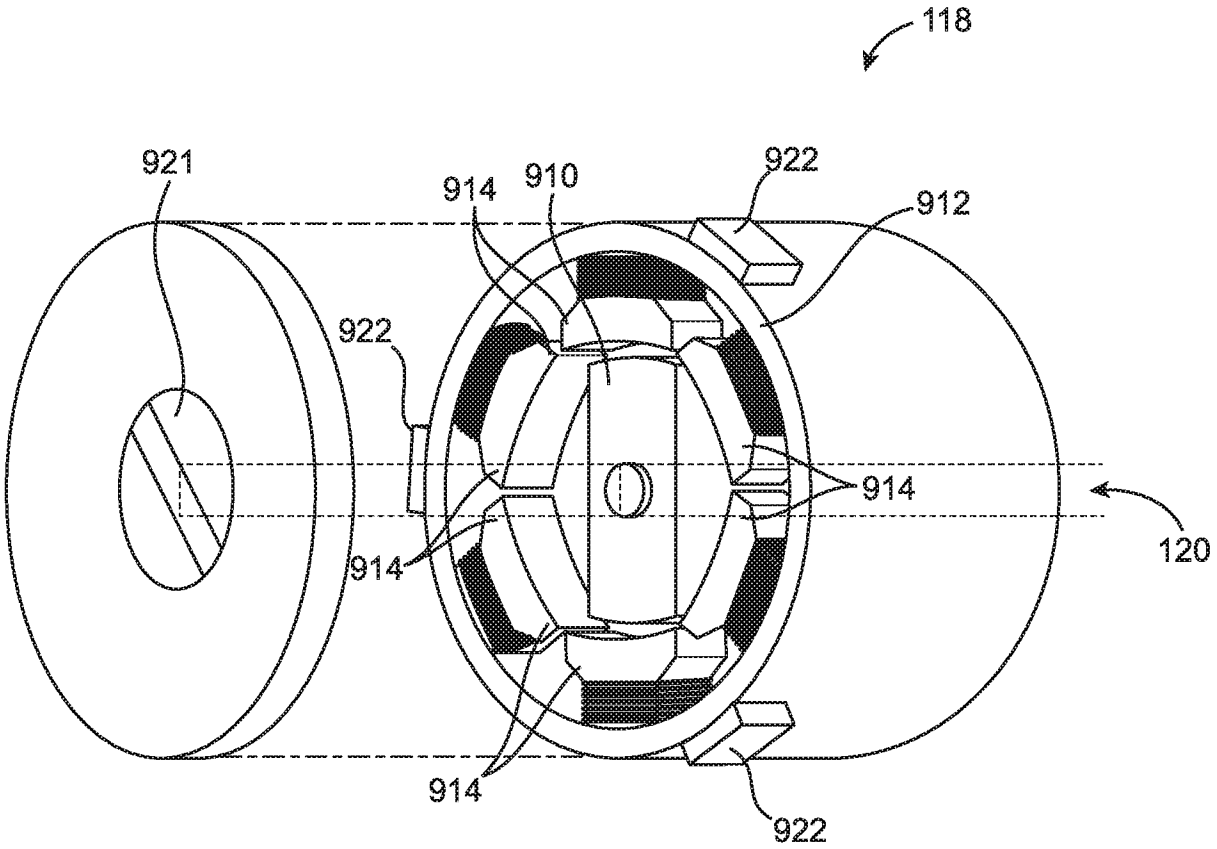
FIG. 5 illustrates a simplified version of component parts of an example of an actuable rotational motor.

FIG. 5 illustrates a simplified version of component parts of an example of an actuable motor 118, which may be an electronically commutated motor (ECM). Illustrated therein is a rotor 910 made up of a magnet and a stator 912 made up of a series of coiled stator pieces 914 surrounding the rotor 910. The relative position of the rotor 910 is used by a motor controller (not shown) for electric commutation of the rotor 910 about rod 120. A resolver 921 may be used to determine this rotor position, and in particular the degrees of rotation. Alternatively, or in addition to the resolver 921, Hall effect sensors 922 can be employed to detect the position of the rotor 910. In still other examples, sensors can be omitted altogether, for instance by employing sensorless commutation techniques used in ECM applications.

Figure 6:
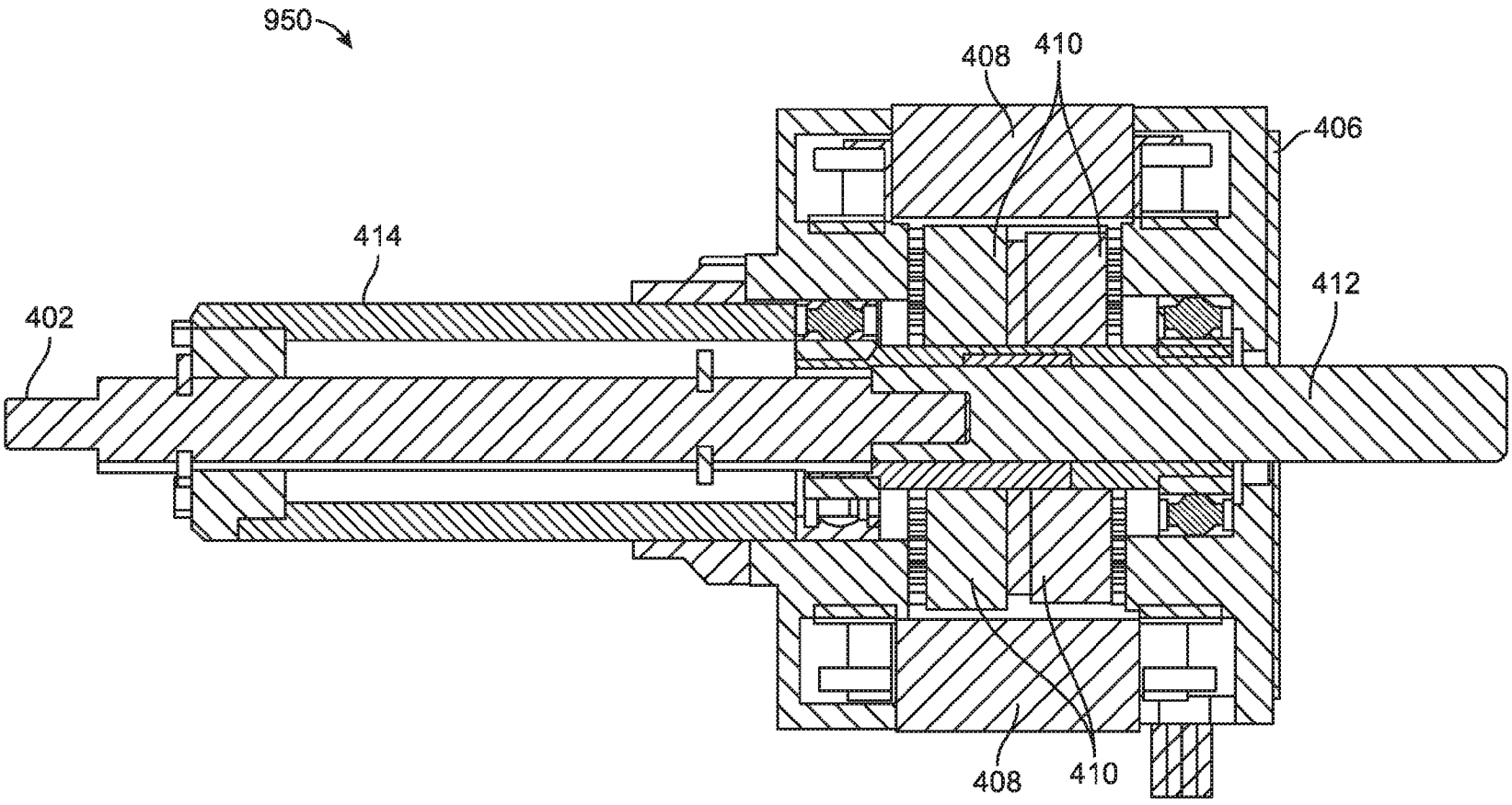
FIG. 6 illustrates another example rotational motor.

FIG. 6 illustrates an example brushless DC motor 950 as an electromechanical motor 118 having a housing 406 and a lead screw 402 connected to or comprising threaded rod 120, (see FIG. 4). The motor 950 can have a stator 408 and magnets 410, for rotation of rotor 412 about the axis 119 formed by rod 120. With rotation of the rotor 412, the lead screw 402 extending from protective sleeve 414 can be rotated and transfer rotational motion to the actuators 124, which in turn cause the keys 110 to rotate within the casing 56.

Figure 7:
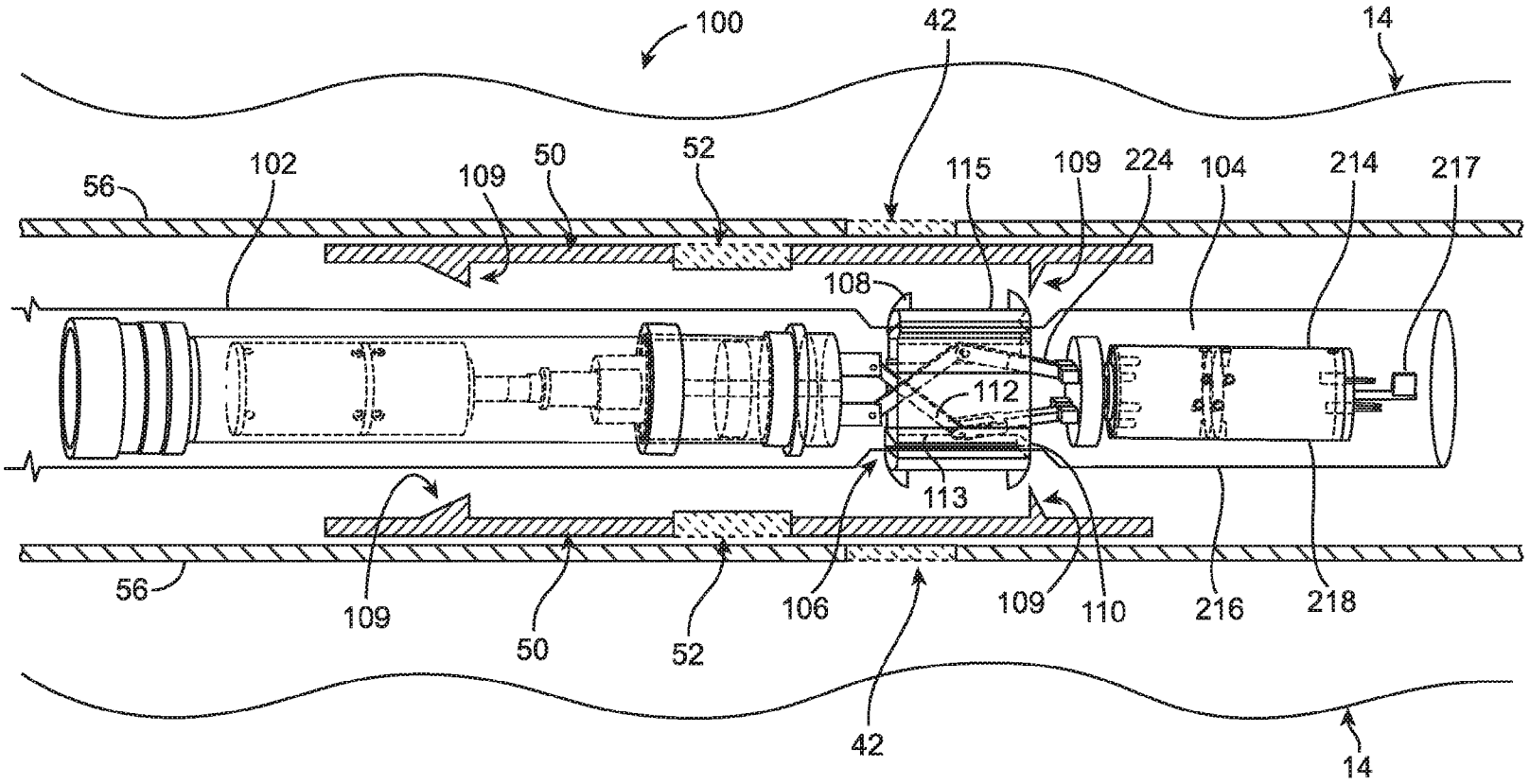
FIG. 7 illustrates an example embodiment of a well intervention tool having vibrational functionality.

FIG. 7 illustrates an example well intervention tool 100 having a vibration function. As can be seen in the figure, the well intervention tool 100 has a longitudinal body 102 which operates within a well casing 56. The longitudinal body 102 has an inner cavity 104 containing various components. The longitudinal body 102 has apertures or slots 106 in its sides. A key assembly 108 is partially housed within the inner cavity 104. The key assembly 108 has key portions 110 which protrude through the apertures 106 from inside the inner cavity 104. As in the case of a well intervention tool having a rotational function (see FIG. 4), the well intervention tool 100 shown in FIG. 7 has translating actuators 112 coupled to an inner side 113 of the key portions 110. The translating actuators 112 (pivotable rods in this example) resiliently urge the key portions 110 outward from within the inner cavity 104, toward the wall of the lining or casing. The well intervention tool 100 illustrated also has a vibration assembly 214 housed within the inner cavity 104 which is used to cause the keys 110 vibrate, either linearly or rotationally, or both. As discussed above, vibrating the keys 110 can cause the outer portion 115 of the keys to shift or displace debris within the door structure 50, thus leading to better engagement between the key assembly 108 and engagement portions 109 of the the door structure 50. The vibration assembly 214 has a casing 216 which contains an actuable vibration motor 218. The casing 216 of the vibration assembly 214 is coupled to one or more vibration actuators 224 (pivotable rods in this example). The vibration actuators are also coupled to the inner sides 113 of the keys 110. Thus, when the 216 and vibration motor 218 vibrate, (linearly or radially), the vibration is transferred to the keys 110 by the vibration actuators 124. As will be explained in greater detail below, the vibration motor 218 is connected to an eccentric mass 217, which in this example is exterior to the motor 218, although it will be understood that other configurations of the motor 218 and mass 217 are possible.

Figure 8:
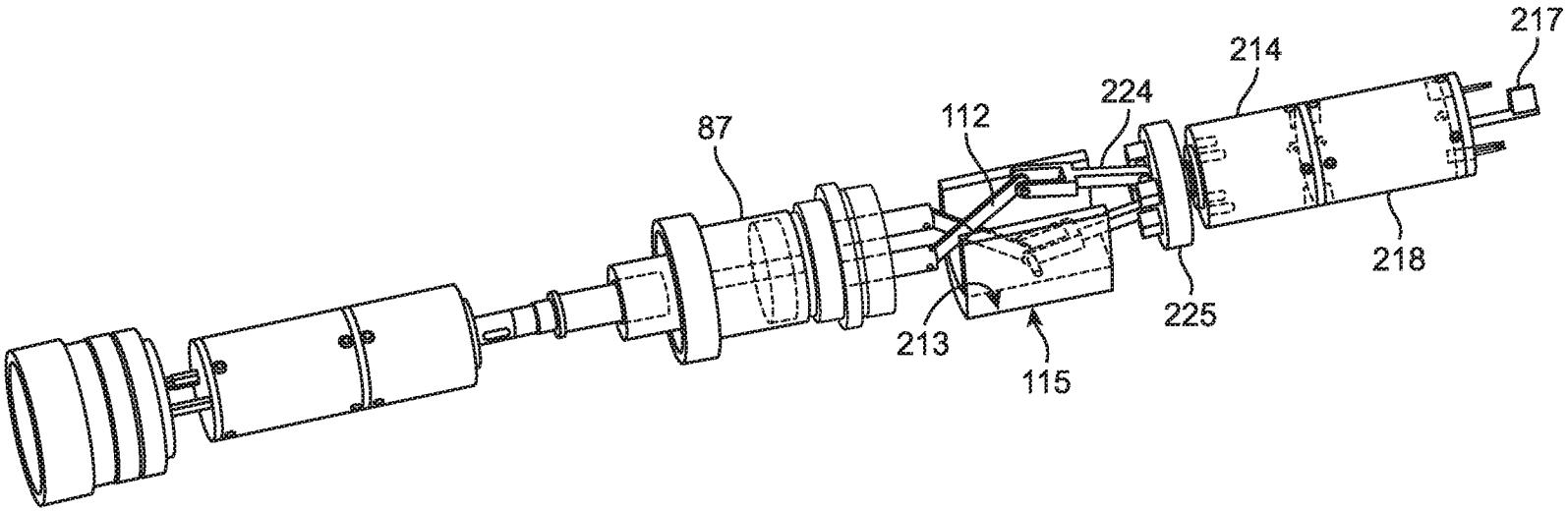
FIG. 8 illustrates a cut away view of the interior of an example embodiment of a well intervention tool.

FIG. 8 illustrates a cut away view of the inner cavity of the longitudinal body (see FIG. 7). As illustrated, translating actuators 112 connect a driving apparatus 87 to undersides 113 of the key portions 110. As explained above, the translating actuators 112 push the outside of the keys 115 away from the inner cavity and toward the inside of a well casing 56. The translating actuators 112 can be pivotably coupled to the vibration actuators 224. The vibration actuators can be pivotably coupled to an actuator receiver such as disc 225. Disc 225 can be connected to vibration assembly 214. Alternatively, the vibration actuators 224 can be directly connected to the vibration assembly 214. As illustrated, the vibration assembly includes an actuable vibration motor 218 connected to an eccentric weight 217.

Figures 9A, 9B:
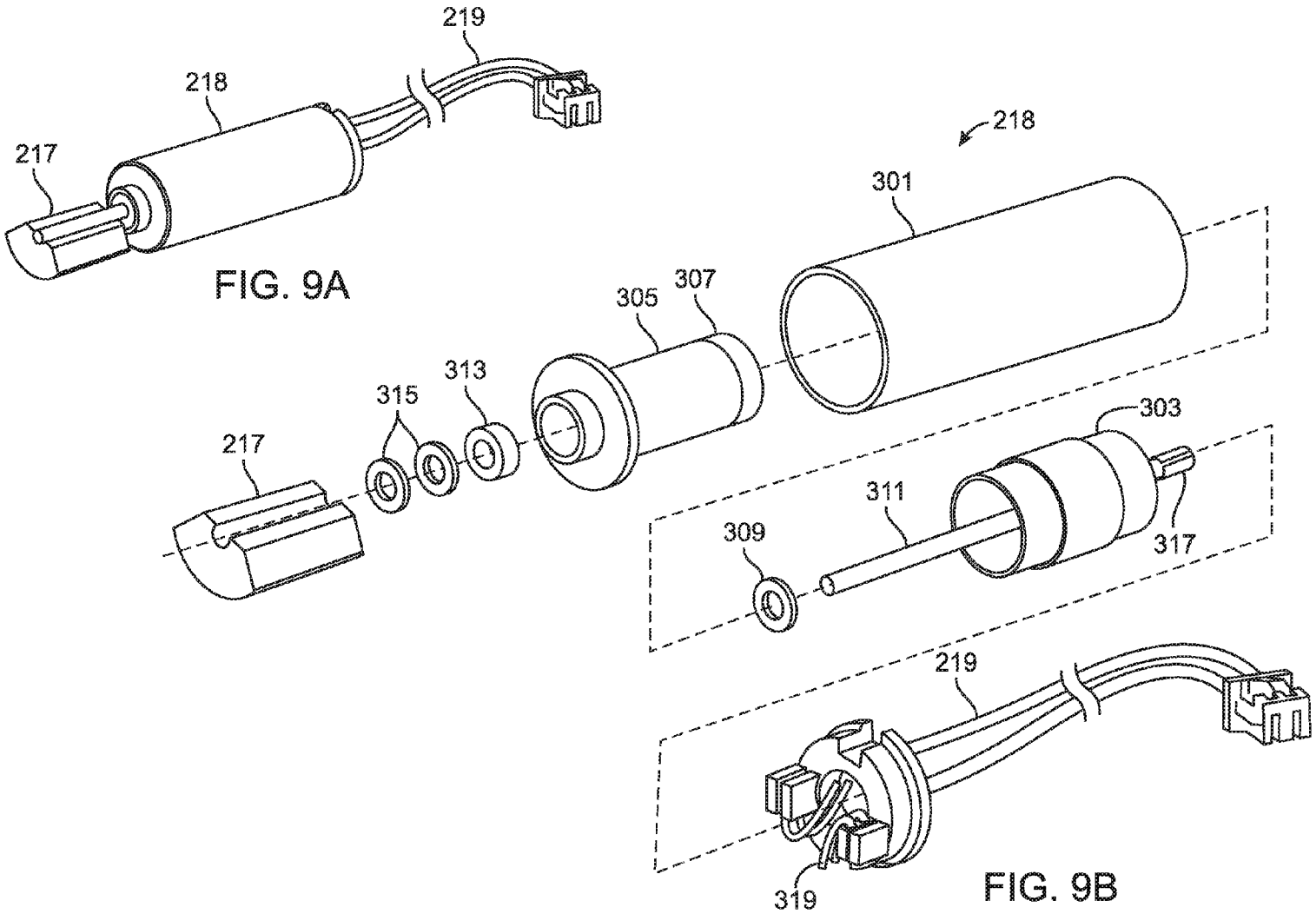
FIG. 9A illustrates an example vibration motor connected to an eccentric mass.
FIG. 9B illustrates an exploded view of an example vibration motor.

FIG. 9A illustrates an example vibration motor 218 connected to an eccentric mass 217. FIG. 9B illustrates an exploded view of an example vibration motor 218. As illustrated, a motor case 301 surrounds coreless windings 303 which in turn surround magnet 305. Magnet 305 abuts rear bearing 307 which abuts bearing washer inside the windings 303. Case 301 and magnet 305 surround shaft 311 which passes through a front bearing 313 and washers 315 and. Shaft 311 is connected to eccentric mass 217 at one end and to a commutator 317 at the other end. Electric current passes through leads 219 via metal bushings 319 into the windings. The current induces the windings 303 and shaft 311 to rotate with respect to magnet 305. Because the shaft is connected to an eccentric mass, the rotation causes the entire motor structure 218 to vibrate. As explained above, the vibration of the motor is ultimately transferred to the keys (see FIGS. 7-8), which will shift or displace debris proximate to the outer portion of the keys 215.

Figure 10B:
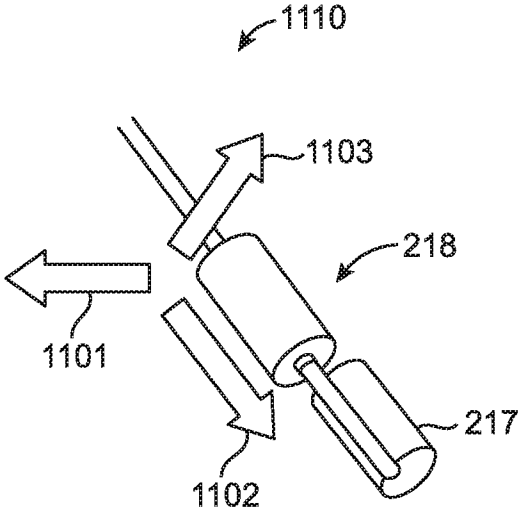
FIG. 10B illustrates an example of linear vibration being induced by a vibration motor.
Figure 10A:
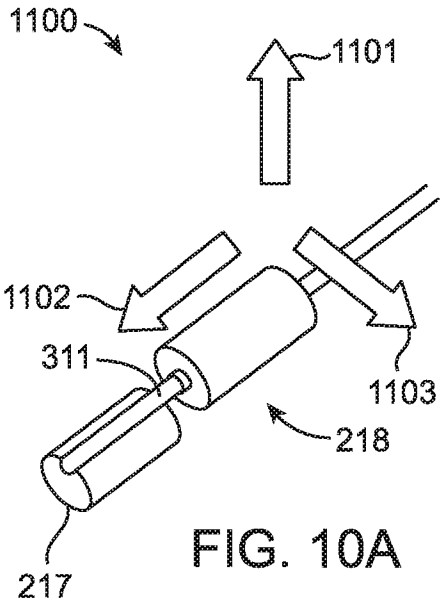
FIG. 10A illustrates an example of radial vibration being induced by a vibration motor.

FIG. 10A illustrates an example of radial vibration 1100 being induced by the vibration motor 218 connected to an eccentric mass or unbalanced load 217. When the vibration has a radial pattern 1100, the motion of the motor 218 has an x-component 1103 and a z-component 1101, but not a y-component (parallel to shaft 311). FIG. 10B illustrates an example of linear vibration 1110 being induced by the vibration motor 218 connected to an eccentric mass or unbalanced load 217. In the linear vibration pattern 1110, vibration in the y-direction 1102 is induced, but not in the x-direction 1103 or the z-direction 1101.

Figure 11:
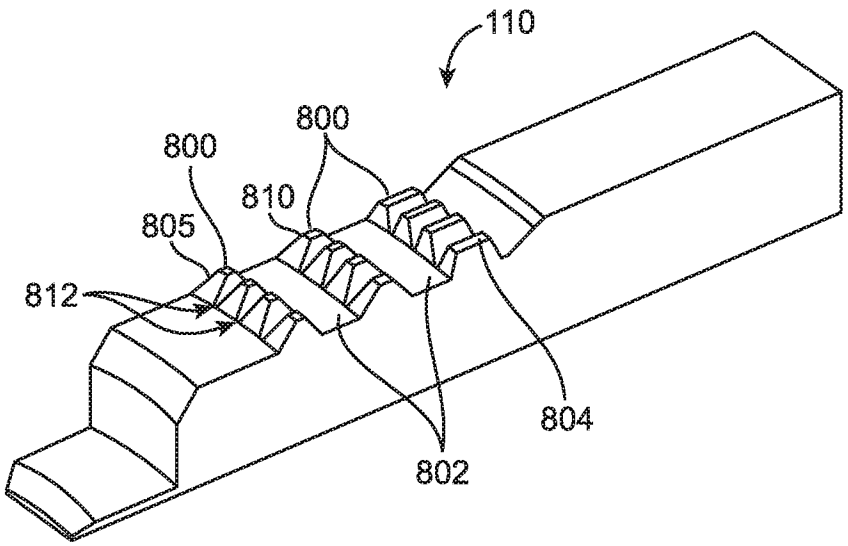
FIG. 11 illustrates and example profile of a shifting key.

FIG. 11 illustrates and example profile of the outside of a key 110. As shown, the exterior of the key 110 can have ridges 800 separated by substantially flat regions 802. Each ridge 800 can be composed of a series of teeth 804. Some of the teeth 804 can have rounded tips 805 to reduce damage to the well casing 56. Some of the teeth 804 can have pointed tips 810 to better penetrate debris within the casing 56. The teeth 804 can be separated by gaps 812 which allow debris to pass between the teeth 804, thus enabling displacement of the debris by the keys 110.

Statements of the Disclosure Include:

Statement 1: A well intervention tool having a rotation assembly, the rotation assembly including a casement containing at least one actuable motor configured to rotate the casement and a key assembly about an axis of a rod coupled to an interior portion of a longitudinal body housing the casement.

Statement 2: The well intervention tool of Statement 1, wherein the key assembly includes at least one key portion, the rotation assembly further including at least one rotation actuator coupled to the casement and to an inner side of key portion.

Statement 3: The well intervention tool of Statement 1 or Statement 2, wherein the actuable motor is a stepper motor with a linear drive.

Statement 4: The well intervention tool of Statement 1 or Statement 2, wherein the actuable motor is a brushless DC electrical motor Statement 5: The well intervention tool of any of the preceding Statements, wherein the actuable motor is configured to cause the casement and the longitudinal body of the completion tool to rotate about a longitudinal axis of the well casing and the longitudinal axis of the longitudinal body.

Statement 6: The well intervention tool of any of the preceding Statements, further including a translating actuator, the translating actuator including a translating rod which is pivotably coupled to a translatable first sleeve located between the inner side of the key portion and the translating rod.

Statement 7: The well intervention tool of Statement 6, wherein a portion of the translating actuator is uphole of the key portion.

Statement 8: The well intervention tool of Statement 6 or Statement 7, wherein the translating rod urges the sleeve and the key portion towards the wall of the casing to cause the key portion to interact with the key-receiving region of the slidable door assembly, enabling the position of the door assembly to be shifted within the well casing by movement of the completion tool.

Statement 9: The well intervention tool of any of the preceding Statements, wherein the key assembly is partially housed within the inner cavity of the completion tool.

Statement 10: The well intervention tool of any one of Statements 2-9, wherein the key portion protrudes through an aperture from within the inner cavity towards an interior wall of a casing.

Statement 11: The well intervention tool of any one of Statements 2-10, wherein the rotation actuator includes a first rod connected to first sleeve, the first sleeve interposed between an inner side of a key portion and the rotation actuator.

Statement 12: The well intervention tool of any one of Statements 2-10, wherein the rotation actuator further includes a second rod connected to a translatable second sleeve interposed between the inner side of a key portion and the rotation actuator.

Statement 13: The well intervention tool of Statement 12, wherein the translatable first sleeve is at least partially nested within the translatable second sleeve.

Statement 14: The well intervention tool of Statement 12, wherein the second sleeve is at least partially nested within the first sleeve.

Statement 15: The well intervention tool of any one of the preceding Statements, wherein the at least one key portion of the key assembly has an outer side located opposite the inner side, which cooperates with a slidable door apparatus interior to a well bore.

Statement 16: A well intervention tool having a vibration assembly, the vibration assembly including a casement containing at least one actuable motor configured to vibrate the casement and a key assembly via a vibration actuator.

Statement 17: The well intervention tool of Statement 16, wherein the actuable motor is configured to impart a linear vibration to the vibration actuator.

Statement 18: The well intervention tool of Statement 16 or Statement 17, wherein the actuable motor is configured to impart a radial vibration to the vibration actuator.

Statement 19: The well intervention tool of any one of Statements 6-18, wherein the translating actuator includes a first translating rod pivotably coupled to a first translatable sleeve interposed between the inner side of the key portion and the translating rod.

Statement 20: The well intervention tool of Statement 19, wherein the translating actuator further includes a second translating rod pivotably coupled to a translatable second sleeve interposed between an inner side of a key portion and the second translating rod.

Statement 21: The well intervention tool of any one of Statements 2-20 wherein the at least one key portion of the key assembly has an outer side located opposite the inner side, the outer side configured to cooperate with a slidable door apparatus interior to a well bore.

Statement 22: The well intervention tool of Statement 21, wherein the outer side of the key portion comprises at least three ridges separated by substantially flat regions.

Statement 23: The well intervention tool of Statement 22, wherein at least one of the three ridges comprises a series of teeth.

Statement 24: The well intervention tool of Statement 23, wherein at least one tooth of the series of teeth has a rounded tip to prevent damage to a casing which interior to the well bore and the sliding door apparatus.

Statement 25: The well intervention tool of Statement 23 or Statement 24, wherein at least one tooth of the series of teeth has a pointed tip to penetrate debris interior to the well bore and the sliding door apparatus.

Statement 26: The well intervention tool of any one of Statements 23-25, wherein at least two teeth of the series of teeth are separated by gaps.

Statement 27: The well intervention tool of Statement 26, wherein the gaps are of sufficient dimensions to allow debris interior to the well bore to flow between the teeth.

Statement 28: A well intervention tool having a rotation-vibration assembly, the rotation-vibration assembly including a casement containing at least one actuable motor configured to:

rotate the casement and a key assembly about an axis of a rod coupled to an interior portion of a longitudinal body housing the casement; and vibrate the casement and the key assembly via a vibration actuator.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A well intervention tool comprising:

a longitudinal body having an inner cavity, the longitudinal body having at least one aperture along a length thereof;

a key assembly partially housed within the inner cavity, the key assembly comprising:

at least one key portion which protrudes through the aperture from within the inner cavity; and at least one translating actuator coupled to an inner side of the key portion, the translating actuator configured to resiliently urge the key portion outward from within the inner cavity; and a rotation assembly housed within the inner cavity, the rotation assembly actuable to rotate the longitudinal body about a longitudinal axis, a casing containing at least one actuable motor configured to rotate the casing about a rod coupled to an interior portion of the longitudinal body;

at least one rotation actuator coupled to the casing and to the inner side of the key portion.

2. The well intervention tool of claim 1, wherein the actuable motor is a stepper motor with a linear drive.

3. The well intervention tool of claim 1, wherein the actuable motor is a brushless DC electrical motor.

4. The well intervention tool of claim 1, wherein the translating actuator comprises a translating rod pivotably coupled to a translatable first sleeve interposed between the inner side of the key portion and the translating rod, and the rotation actuator comprises a second rod connected to a second sleeve interposed between the inner side of the key portion and rotation actuator.

5. The well intervention tool of claim 4, wherein the first sleeve is at least partially nested within the second sleeve.

6. The well intervention tool of claim 4, wherein the second sleeve is at least partially nested within the first sleeve.

7. The well intervention tool of claim 1, wherein the key portion has an outer side opposite the inner side, the outer side configured to cooperate with a slidable door apparatus interior to a well bore.

8. A well intervention tool comprising:

a longitudinal body having an inner cavity, the longitudinal body having at least one aperture along a length thereof;

a key assembly partially housed within the inner cavity, the key assembly comprising:

at least one key portion which protrudes through the aperture from within the inner cavity; and at least one translating actuator coupled to an inner side of the key portion, the translating actuator configured to resiliently urge the key portion outward from within the inner cavity; and a vibration assembly housed within the inner cavity, the vibration assembly actuable to vibrate the key portion.

9. The well intervention tool of claim 8, wherein the vibration assembly comprises:

a casing containing at least one actuable motor configured to vibrate the casing;

at least one vibration actuator coupled to the casing and to the inner side of the key portion, the vibration actuator configured to impart a vibration of the casing to the key portion.

10. The well intervention tool of claim 9, wherein the actuable motor is configured to impart a linear vibration to the vibration actuator.

11. The well intervention tool of claim 9, wherein the actuable motor is configured to impart a radial vibration to the vibration actuator.

12. The well intervention tool of claim 9, wherein the translating actuator comprises a first translating rod pivotably coupled to a first translatable sleeve interposed between the inner side of the key portion and the translating rod, and the vibration actuator comprises a first vibration rod pivotably coupled to the first translating rod and the first sleeve.

13. The well intervention tool of claim 12, wherein the translating actuator comprises a second translating rod pivotably coupled to a translatable second sleeve interposed between an inner side of a key portion and the second translating rod, and the vibration actuator comprises a second vibration rod pivotably coupled to the second translating rod and the second sleeve.

14. The well intervention tool of claim 13, wherein the first sleeve is at least partially nested within the second sleeve.

15. The well intervention tool of claim 13, wherein the second sleeve is at least partially nested within the first sleeve.

16. The well intervention tool of claim 8, wherein the key portion has an outer side opposite the inner side, the outer side configured to cooperate with a slidable door apparatus interior to a well bore.

17. A key portion of a well intervention tool, the key portion configured to releasably engage with a sliding door apparatus interior to a well bore, the key portion having an outer side comprising at least three ridges separated by substantially flat regions, wherein at least one of the three ridges comprises a series of teeth.

18. The key portion of claim 17, wherein at least one tooth comprised by the series of teeth has a rounded tip to prevent damage to a casing interior to the well bore and the sliding door apparatus.

19. The key portion of claim 17, wherein at least one tooth comprised by the series of teeth has a pointed tip to penetrate debris interior to the well bore and the sliding door apparatus.

20. The key portion of claim 17, wherein at least two teeth comprised by the series of teeth are separated by gaps to allow debris interior to the well bore to flow between the teeth.

* * * * *